US009193637B1

(12) United States Patent
Sabatini et al.

(10) Patent No.: US 9,193,637 B1
(45) Date of Patent: Nov. 24, 2015

(54) MAGNESIUM/ALKYL POLYSULFIDE WHITE STAR ILLUMINANTS

(71) Applicants: Jesse J. Sabatini, Denville, NJ (US); Leon L. Robert, Jr., West Point, NY (US); Jared D. Moretti, Randolph, NJ (US)

(72) Inventors: Jesse J. Sabatini, Denville, NJ (US); Leon L. Robert, Jr., West Point, NY (US); Jared D. Moretti, Randolph, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 91 days.

(21) Appl. No.: 13/948,453

(22) Filed: Jul. 23, 2013

(51) Int. Cl.

| | |
|---|---|
| ***C06B 31/00*** | (2006.01) |
| ***C06B 31/02*** | (2006.01) |
| ***D03D 23/00*** | (2006.01) |
| ***D03D 43/00*** | (2006.01) |

(52) U.S. Cl.
CPC ..... *C06B 31/02* (2013.01)

(58) Field of Classification Search
USPC ..... 149/2, 61, 45, 108.2, 109.2, 109.4
See application file for complete search history.

(56) References Cited

U.S. PATENT DOCUMENTS 3,986,907 A * 10/1976 Dillehay ..... 149/19.6

* cited by examiner

*Primary Examiner* — James McDonough
(74) *Attorney, Agent, or Firm* — Henry S. Goldfine

(57) ABSTRACT

A white star pyrotechnic illuminant composition, useful in US military M127A1 parachuted hand held signals (HHS), which illuminant provides surprisingly enhanced luminous intensity and luminous efficiency versus the current M127A1 U.S. military HHS white star pyrotechnic illuminant. The inventive illuminant formulation includes a mixture of powdered sodium nitrate, magnesium, alkyl polysulfide polymer and a binder; wherein the magnesium and alkyl polysulfide is preferably recovered from the demilitarization of obsolete munitions to realize a significant savings.

6 Claims, No Drawings

MAGNESIUM/ALKYL POLYSULFIDE WHITE STAR ILLUMINANTS

FEDERAL RESEARCH STATEMENT

The inventions described herein may be manufactured, used and licensed by, or for, the U.S. Government, for U.S. Government purposes.

BACKGROUND OF INVENTION

1. Field of the Invention

The present invention relates to enhanced performance white star hand held signal illuminants, and more particularly, to such illuminants containing a mixture of magnesium and alkyl polysulfide polymer, which mixture is preferably recovered from demilitarized illuminants and munitions to yield significant savings.

2. Background Art

Light emitting pyrotechnics are an invaluable asset in any battlefield environment, especially after sunset. Such pyrotechnics are used to signal troops with ease to see and understand instructions or warnings, and to illuminate portions of the battlefield to disclose enemy troop movements. There are two general types of pyrotechnics used by ground troops—hand signals (HHS) and ground signals. Hand signals are self contained rocket-type devices that are designed to reach a minimum height of about 180 to about 250 meters. HHS include star illuminating pyrotechnics, which return to earth slowly, supported by a parachute, and star cluster pyrotechnics, which fall back to earth on their own, providing shorter illumination times. Smoke type pyrotechnics provide a signal only, which is parachuted back to earth to maximize the suspense time for maximum visibility of the signal.

A particular type of HHS pyrotechnic of interest is the M127A1 white star parachute surface-to-air illuminant—which is primarily used as a distress signal; but, which is also useful for battlefield illumination. This particular illuminant is propelled by a fin-stabilized rocket, which is housed in a ten-inch, hand-held aluminum launching tube, which weighs about 1.2 pounds. The rocket propels the illuminant to an altitude of about 210 to 215 meters, whereupon the white star illuminant is ignited and parachuted back to the ground—burning for about 30 seconds with a luminous intensity of about 135,000 candela The current M127A1 HHS pyrotechnic formulation consists of a magnesium fuel, sodium nitrate as an oxidizer, and a Laminac 4116/Lupersol binder system. The binder system contains Laminac 4116, which has been identified as a single-point-of-failure (SPF) material since it is being produced by only one company and therefore there is a possibility that that company may discontinue production due to low product demand or other reasons. In addition, Laminac has significant storage and longevity issues, due only a limited 6 month shelf life before decomposing. Laminac is a polyester-based binder cross-linked with styrene; a compound with its own issues relating to carcinogenicity. Styrene is a volatile organic compound (VOC) and thus presents a possible fire/explosion hazard during manufacture. Such that, it has been proposed to use an epoxy binder system in place thereof. See, Sabatini, et al, *An Examination of Binder Systems and Their Influences on Burn Rates of High-Nitrogen Containing Formulations, Propellants, Explosives, Pyrotechnics* vol. 36, issue 2, April 2011. p. 145-150.

More significantly, the current M127A1 pyrotechnic formulation uses a 30/50 mesh magnesium powder that conforms to Military Specification 14067-B, 10 Mar. 1967, which mandates 98.0 percent minimum purity magnesium (allowing only a maximum of 1.5% zinc, 0.5% maximum alloy as iron, and small percentages of volatile materials, carbides, and other impurities. Such a high standard allows only the use of newly manufactured, high purity magnesium, which material is relatively expensive and does not allow the use of plentiful magnesium which may be recovered and recycled from old munitions; but, which may be of lesser purity.

Back in September 1966, published U.S. Army Munitions Command Technical Report 3364, titled *Comparison of Mechanically Balled Magnesium with Atomized Magnesium for use in Pyrotechnic Composition*, authored by James A Carrazza, Jr., et al, concluded that the pyrotechnic performance of ball milled magnesium 30/50 mesh powder compared favorably to atomized magnesium—such that Military Specification 14067 could be amended to allow its use as a substitute for the then required atomized material. However, the Army standard for both the ball milled and atomized magnesium then, and for the last 50 plus years, has been mandated as meeting the 98.0% purify standard.

There is a need in the art for an alternative to the 98.0% pure magnesium used in military HHS pyrotechnic illuminants, i.e. a less pure and significantly lower cost material; and, there is a need for a HHS binder system which is not subject to the SPF of the present Laminac 4116 system.

SUMMARY OF INVENTION

The present invention addresses the need in the art for an economical white star pyrotechnic illuminant composition which does not utilize the SPF Laminac 4116 binder and which preferably uses demilitarized magnesium recovered from unserviceable illuminating pyrotechnics and munitions of less than 98.0% purity—wherein the magnesium is a mixture of magnesium and alkyl polysulfide polymer. Interestingly, and surprisingly, the inventive mixture of magnesium and alkyl polysulfide polymer based illuminant composition provides significantly enhanced performance, i.e. luminous efficiency, versus the current white star pyrotechnic illuminant system. Further, the present invention is a relatively simple mixture; wherein, (1) the oxidizer is powdered sodium nitrate; (2) the fuel is recycled magnesium of relatively low purity that contains an alkyl polysulfide polymer; and (3) the binder system is bisphenol-A epoxy polymer (about 80%) and a polyamide cross-linking agent (about 20%). The subject inventive composition surprisingly has been shown to provide up to 1.27 times the luminosity and up to 1.21 times the luminous efficiency of an equal quantity of the prior art white star HHS pyrotechnic illuminant—i.e. luminosity in candela (cd) and luminous efficiency in $[cds^{-1}]g^{-1}]$. And, the burn time of the subject inventive composition is equal to or slightly better than that of the prior art white star pyrotechnic composition—which prior art composition require very high purity, i.e. 98%, magnesium and lack (are free of) any alkyl polysulfide polymer.

Preferred embodiments of the present inventive white star pyrotechnic illuminant contain a quantity of (1) powdered sodium nitrate, from about 25 to about 35 percent by weight, more preferably, about 29 to 31 percent by weight, and most preferably about 30+/−0.5 percent by weight; (2) a quantity of magnesium and an alkyl polysulfide polymer powders (preferably recovered from old, unserviceable illuminating pyrotechnics; wherein, the magnesium is of less than 98% purity), from about 63 to about 69 percent by weight, more preferably about 65 to about 67 percent by weight, and most preferably about 66+/−0.5 percent by weight; and a quantity of a bisphenol-A epoxy polymer (about 80%)/polyamide cross-linking agent (about 20%) binder system, about 3 to about 7 percent by weight, more preferably about 3 to 5 weight percent, and most preferably about 4+/−0.5 weight percent by weight. The magnesium having a mean volume particle size distribution of 508.7-743.6 μm and the quantity of magnesium to sulfur being about 85%:15% to about 93%:7%—including all ratios therebetween as determined by X-ray fluorescence.

Additional features and advantages of the present invention will be set forth in, or are apparent from, the detailed description of preferred embodiments thereof which follows.

DETAILED DESCRIPTION OF THE INVENTION

As detailed herein, the white star pyrotechnic illuminant of the present invention comprises a mixture of powdered sodium nitrate, a magnesium and alkyl polysulfide polymer powder mixture (preferably of recycled material from obsolete illuminating pyrotechnics and munitions—to realize significant savings), and a binder—the binder preferably being a mixture of bisphenol-A epoxy polymer and a polyamide cross-linking agent. The magnesium (508.7-743.6 μm) with alkyl polysulfide polymer mixture, having a desired quantity of about 7% to about 15% sulfur, is available as recovered material from obsolete military illuminants and munitions—e.g. 60 mm mortar, 81 mm mortar, 4.2 inch illuminant, and LUU-2 shells—where such recovered material is available from the Crane Army Ammunition Activity Plant (CAAA), located in Crane, Ind.

The prior art M127A1 white star pyrotechnic illuminant is a combination of powdered sodium nitrate, magnesium 30/50 mesh and a Laminac 4116/Lupersol binder—the weight percentages of which are shown in Table 1, below:

TABLE 1

Composition of current in-service US Army M127A1 White Star Illuminant.

| Component | Weight Percentage (%) |
|---|---|
| Sodium Nitrate | 29% |
| Magnesium 30/50 | 66% |
| Laminac 4116/Lupersol Binder System | 5% |

In the current, i.e. prior art M127A1 white star pyrotechnic illuminant composition, the magnesium serves as the fuel, powdered sodium nitrate serves as the oxidizer, and the Laminac 4116/Lupersol binder system serves as the binder system. Such that the magnesium reacts with the oxygen from the pyrotechnic oxidizer and from oxygen in the atmosphere—whereby magnesium oxide is formed. Whereby the magnesium oxide particles are incandescent, meaning that they emit light across the entire ROYGBIV color spectrum, the light emitted as they burn is perceived by the view as white. Further, the decomposition of sodium nitrate yields atomic sodium—which greatly contributes to the overall light output of the illuminant and imparts a yellow color to the flame. The Laminac 4116/Lupersol binder system, a polyester-based organic polymer, functions to preserve the homogeneity of the pyrotechnic mixture, preventing separation of the fuel and oxidizers. Furthermore, the binder is used to ensure rigidity and mechanical strength of the formulation when it is consolidated into pellets for loading into a white star-emitting rocket.

The white star pyrotechnic illuminant composition of the present invention is free of the single-point-of-failure Laminac binder of the prior art M127A1 white star pyrotechnic illuminant composition. Alternative preferred embodiments of the present invention are shown in Table 2, below, which embodiments (as discussed below) provide significantly enhanced luminous intensity and luminous efficiency versus the prior art M127A1.

TABLE 2

Alternative preferred embodiments of the present invention - exhibiting enhanced luminous intensity and luminous efficiency

| Component | Embodiment 1 (wt. percentage) | Embodiment 2 (wt. percentage) | Embodiment 3 (wt. percentage) |
|---|---|---|---|
| Powdered Sodium Nitrate | 29 +/− 1% | 29 +/− 1% | 29 +/− 1% |
| Magnesium/Alkyl Polysulfide Polymer Powder Binder | 66 +/− 1%; 86.6:12.4 Mg to sulfur ratio 3-5% | 66 +/− 1%; 82.25:10.85 Mg to sulfur ratio 3-5% | 66 +/− 1%; 91.5:7.5 Mg to sulfur ratio 3-5% |

The performance of the alternative embodiments of the present formulation shown in Tables 2 are compared to the current US Military Specification for such white star pyrotechnic illuminants and to the specifications of the current in-service M127A1 white star pyrotechnic illuminant in Table 3, below.

TABLE 3

Performance of alternative embodiments of the present invention vs. the US Military Specification for such white star pyrotechnic illuminants and vs. the current in-service M127A1 white star pyrotechnic illuminant

| Formulation | BT[a] [s] | LI[b] [cd] | LE[c] [[cd · s]$g^{-1}$] | DW[d] [nm] | Sp[e] [%] | MPS[f] [μm] |
|---|---|---|---|---|---|---|
| Mil Spec | 25.0 (minimum) | 90,000.00 | Not specified | Not specified (see note) | Not specified (see note) | Not specified |
| Current M127A1 | 29.7 | 133,627.00 | 46,690.00 | 586.4 | 84.2 | 523.4 |
| Embodiment 1 | 29.9 | 170,000.00 | 54,644.20 | 585.9 | 79.5 | 508.7 |

TABLE 3-continued

Performance of alternative embodiments of the present invention vs. the US Military Specification for such white star pyrotechnic illuminants and vs. the current in-service M127A1 white star pyrotechnic illuminant

| Formulation | BT[a] [s] | LI[b] [cd] | LE[c] [[cd · s]g$^{-1}$] | DW[d] [nm] | Sp[e] [%] | MPS[f] [μm] |
|---|---|---|---|---|---|---|
| Embodiment 2 | 33.3 | 149,666.70 | 53,974.00 | 586 | 79.6 | 743.6 |
| Embodiment 3 | 32.4 | 162,333.00 | 56,848.00 | 586 | 80.4 | 530.6 |

[a]BT = burn time;
[b]LI = luminous intensity;
[c]LE = luminous efficiency;
[d]DW = luminous intensity;
[e]SP = spectral purity;
[f]MPS = mean volume particle size of magnesium used.
Note: the current military specification for white star pyrotechnic illuminants does not specify (include) luminous efficiency, dominant wavelength and spectral purity specifications.

As stated above and shown in Table 3, surprisingly, the illuminant compositions of Embodiments 1 to 3 provide up to 1.27 times the luminosity and up to 1.21 times the luminous efficiency compared to an equal quantity of the current, in-service M127A1 white star pyrotechnic illuminant. In addition to these increases in the most relevant properties of an illuminant, as also shown above, the alternative embodiments of the present inventions do not suffer from any significant degradation of burn time, dominant wavelength, or spectral purity of the emitted light.

The prior art M127A1 formulation is initiated by an electric match that touches the top surface of a known, thermite-based, igniter slurry (i.e. a mixture of potassium nitrate, charcoal, black iron oxide, aluminum, silicon and nitrocellulose binder, with acetone as the required solvent for formulating these ingredients)—that is intimately in contact with the M127A1 white star pyrotechnic illuminant for ignition. Correspondingly, the alternative embodiments of the present invention require the same igniter, and intimate contact therewith, to be initiated. Upon initiation, the alternative embodiments of the present invention, i.e. formulations of the present invention, react to generate gaseous products, heat, smoke, and ash. The heat produced from the reaction is sufficient to encourage a reduction-oxidation reaction between fuels and oxidizers in the inventive formulation; wherein, the sodium nitrate of the present invention serves as the oxidizer, the magnesium serves as the fuel and the binder system provides the needed homogeneity and other desired physical properties of the mixture. Specifically, the sodium nitrate will react with magnesium to form magnesium oxide. This reactions process is exothermic, and results in grey body emission, resulting in the formulation's observed luminous intensity. The emission of sodium atoms also contributes substantially to the observed light intensity (luminous intensity) and imparts a yellowish color to an otherwise white-colored flame.

The alternative embodiments of the present invention were prepared in the lab, by measuring about 4 weight percent of bisphenol-A epoxy polymer (such as Epon 813, available from Momentive Specialty Chemicals, Inc., Columbus, Ohio) into an air mixing bowl, followed by 1 weight percent of the polyamide cross-linking agent (such as Versamid 140, available from Cognis, a BASF company, Budd Lake, N.J.). The resulting mixture was stirred vigorously by hand with a wooden tongue depressor for 1 minute. About 66 weight percent of a recovered magnesium/alkyl polysulfide polymer mixture was then added to the binder system, and with the aid of a B-blade, the resulting mixture was blended for 10 minutes in the bowl under a pressure of about 30 psi. After 10 minutes of mixing time, the air was turned off, the B-blade was removed, and a wooden tongue depressor was used to scrape the sides of the mixing bowl to remove any material from the sides thereof. The B-blade was reattached, and powdered sodium nitrate was added to the reaction mixture. Mixing commenced for 10 minutes under about 30 psi of pressure. After the 10 minutes of mixing time, the air was turned off, the B-blade was removed, and a wooden tongue depressor was used to scrape the sides of the mixing bowl to remove any material from the sides thereof. The B-blade was reattached, and mixing resumed for an additional 10 minutes under about 30 psi of pressure—to obtain a through and homogeneous mixture.

After mixing was completed, the B-blade was removed, and the material in the mixing bowl was transferred to a large ceramic bowl. The pyrotechnic mixture was allowed to partially cure at ambient temperature overnight, and the pyrotechnic material was ready for consolidation into non-coated Kraft fiberboard tubes.

Although the invention has been described above in relation to preferred embodiments thereof, it will be understood by those skilled in the art that variations and modifications can be effected in these preferred embodiments without departing from the scope and spirit of the invention. Further, while specific ratio may have been used by way of example/specific embodiments, it is also understood by those skilled in the art that quantities of the materials between and about the ratios are equally functional.

What is claimed is:

1. A white star pyrotechnic illuminant composition for use in hand held signals, which illuminant provides enhanced luminous intensity and luminous efficiency, comprising:

powdered sodium nitrate from about 25 to about 35 weight percent, recovered magnesium having purity less than 98% mixed with, alkyl polysulfide polymer wherein said mixture is about 63 to about 69 weight percent and wherein the ratio of recycled magnesium to alkyl polysulfide polymer is about 93:7 to about 85:15 percent, and a binder at about 3 to about 7 weight percent.

2. The white star pyrotechnic illuminant of claim 1, wherein:

(a) the quantity of sodium nitrate is from about 25 to about 35 weight percent;

(b) the quantity of magnesium and alkyl polysulfide polymer mixture is from about 63 to about 69 weight percent;

(c) wherein the ratio of magnesium to sulfur is about 93:7 to about 85:15 percent; and (d) the quantity of binder is about 3 to about 7 weight percent.

3. The white star pyrotechnic illuminant of claim 2, wherein the magnesium has a mean volume particle size of 508.7-743.6 μm.

4. The white star pyrotechnic illuminant of claim 1, wherein the binder is 80% by weight of an bisphenol-A epoxy polymer and 20% by weight of a polyamide cross-linking agent.

5. The white star pyrotechnic illuminant of claim 1, wherein the magnesium and alkyl polysulfide polymer mixture is recovered from obsolete illuminating pyrotechnics or munitions.

6. The white star pyrotechnic illuminant of claim 1, wherein the magnesium and alkyl polysulfide polymer mixture is recovered from obsolete illuminating pyrotechnics or munitions.

* * * * *